US011194293B2

(12) United States Patent
Akiyama et al.

(10) Patent No.: US 11,194,293 B2
(45) Date of Patent: Dec. 7, 2021

(54) ELECTRONIC TIMEPIECE

(71) Applicant: Seiko Epson Corporation, Tokyo (JP)

(72) Inventors: Toshikazu Akiyama, Matsumoto (JP); Shuichi Tamura, Matsumoto (JP)

(73) Assignee: Seiko Epson Corporation

( * ) Notice: Subject to any disclaimer, the term of this patent is extended or adjusted under 35 U.S.C. 154(b) by 1 day.

(21) Appl. No.: 16/810,942

(22) Filed: Mar. 6, 2020

(65) Prior Publication Data

US 2020/0285198 A1 Sep. 10, 2020

(30) Foreign Application Priority Data

Mar. 7, 2019 (JP) ..... JP2019-041586

(51) Int. Cl.
*G04C 3/00* (2006.01)
*G04G 21/02* (2010.01)
*G04C 3/14* (2006.01)

(52) U.S. Cl.
CPC ..... *G04C 3/002* (2013.01); *G04G 21/02* (2013.01); *G04C 3/146* (2013.01)

(58) Field of Classification Search
CPC ..... G04C 3/002; G04C 3/146; G04C 3/14; G04G 21/02; G04G 9/0076; G04R 20/30; G04R 20/26
USPC ..... 368/190
See application file for complete search history.

(56) References Cited

U.S. PATENT DOCUMENTS

2014/0092714 A1* 4/2014 Nagareda ..... G04C 9/00 368/187
2017/0060098 A1 3/2017 Yonekura et al.
2019/0079461 A1* 3/2019 Maruyama ..... G04G 9/0064

FOREIGN PATENT DOCUMENTS

GB 2 217 484 A 10/1989
JP H01-305394 A 12/1989
JP 2008-134129 A 6/2008
JP 2017-049228 A 3/2017

* cited by examiner

*Primary Examiner* — Edwin A. Leon
(74) *Attorney, Agent, or Firm* — Harness, Dickey & Pierce, P.L.C.

(57) ABSTRACT

An electronic timepiece improves operability when manually adjusting the time. The electronic timepiece includes: a time display configured to indicate the time; a rotatable crown that can be pulled out to multiple stop positions, including a first position and a second position; a stop position detector configured to detect the stop position of the crown; an operation detector configured to detect an operation rotating the crown; and a time setter configured to change the time displayed by the time display according to an adjustment amount that differs according to the stop position at each detected operation when the stop position is the first position or the second position and the operating detector detects the operation.

10 Claims, 11 Drawing Sheets

ELECTRONIC TIMEPIECE

BACKGROUND

1. Technical Field

The present invention relates to an electronic timepiece having an analog display or a digital display.

The present application claims priority based on and incorporates by reference the entire contents of Japan Patent Application No. 2019-041586 filed in Japan on Mar. 7, 2019.

2. Related Art

JP-A-2017-49228 discloses an electronic timepiece in which a local time setting process is executed when the crown is pulled out two stops, and either the hour hand is moved one hour when rotation of the crown is then detected, or the minute hand is moved 15 minutes when a push-button switch is pressed.

When the target to be adjusted is the same local time in the electronic timepiece described in JP-A-2017-49228, the user must operate the crown or button in different ways according to the distance the hand must move. Operability is therefore poor and operating errors can therefore occur with a typical user not trained in the different operations of the crown and button.

SUMMARY

An electronic timepiece according to an aspect of the present disclosure includes a time display configured to indicate the time; a rotatable crown that can be pulled out to multiple stop positions, including a first position or a second position; a stop position detector configured to detect the stop position of the crown; an operation detector configured to detect an operation rotating the crown; and a time setter configured to change the time displayed by the time display according to an adjustment amount that differs according to the stop position at each detected operation when the stop position is the first position or the second position and the operating detector detects the operation.

An electronic timepiece according to another aspect of the present disclosure includes a time display configured to indicate the time; a rotatable crown that can be pulled out to multiple stop positions, including a first position or a second position; an operator other than the crown; a stop position detector configured to detect the stop position of the crown; an operation detector configured to detect an operation of the operator; and a time setter configured to change the time displayed by the time display according to an adjustment amount that differs according to the stop position at each detected operation when the stop position is the first position or the second position and the operating detector detects the operation.

In an electronic timepiece according to another aspect of the present disclosure, the time setter sets the time by setting a time difference of the time displayed by the time display.

In an electronic timepiece according to another aspect of the present disclosure, the time setter sets the adjustment amount of the time difference set at each operation to one hour when the stop position is the first position, and sets the adjustment amount of the time difference set at each operation to fifteen minutes when the stop position is the second position.

In an electronic timepiece according to another aspect of the present disclosure, the time setter sets the adjustment amount of the time adjustment made at each operation to one hour when the stop position is the first position, and sets the adjustment amount of the time adjustment made at each operation to one minute when the stop position is the first position.

In an electronic timepiece according to another aspect of the present disclosure, the operator other than the crown is a button.

Other objects and attainments together with a fuller understanding of the invention will become apparent and appreciated by referring to the following description and claims taken in conjunction with the accompanying drawings.

DESCRIPTION OF EMBODIMENTS

Embodiment 1

Figure 1:
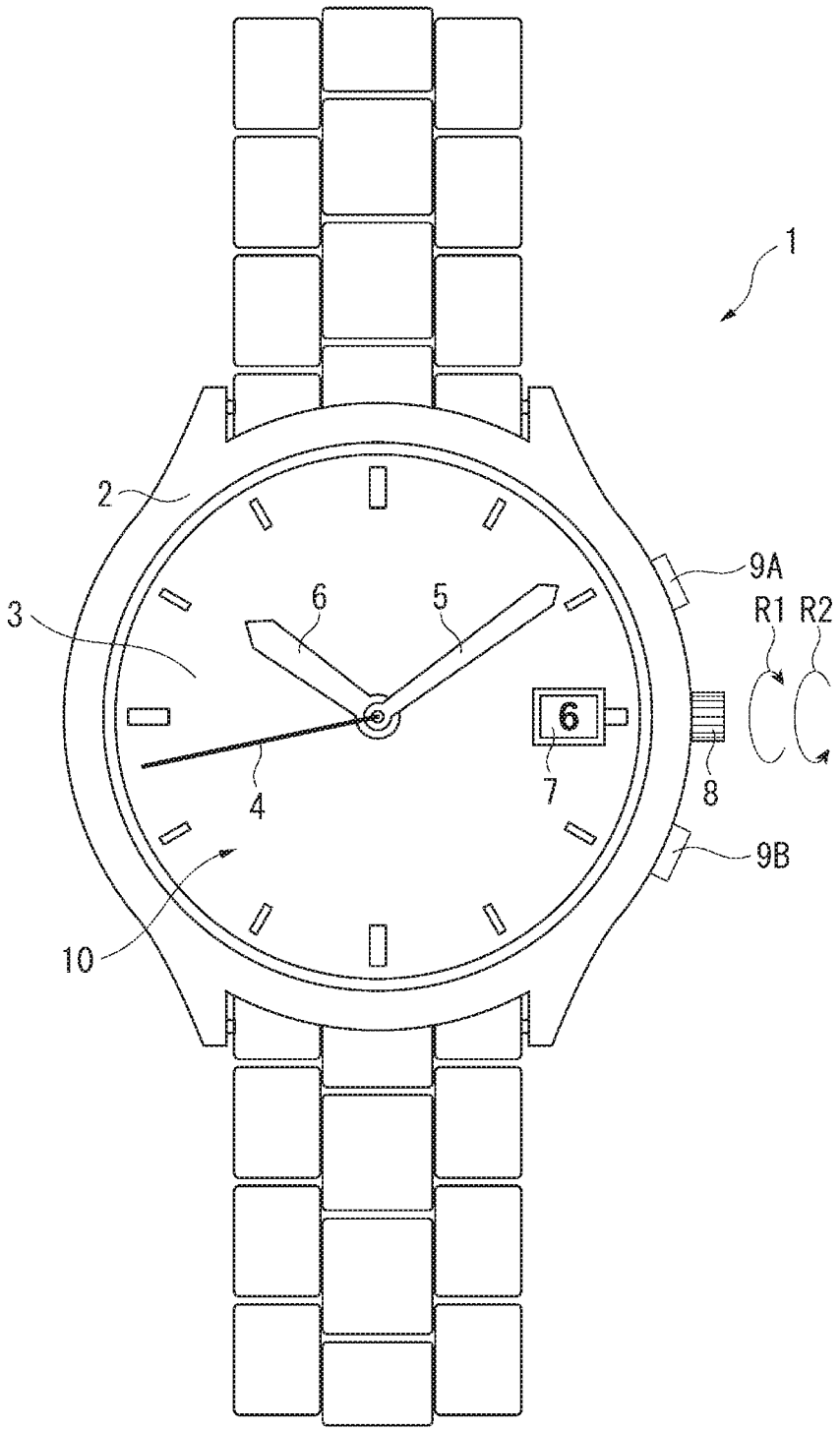
FIG. 1 is a front view of an electronic timepiece according to the first embodiment.

An electronic timepiece 1 according to the first embodiment of the present disclosure is described below with reference to the accompanying figures.

This electronic timepiece 1 has a case 2, a dial 3 disposed inside the case 2, an second hand 4, minute hand 5, and hour hand 6 attached to three pivots disposed in the plane center of the dial 3, a date wheel 7, a crown 8, a button 9A, and a button 9B.

The time display unit 10 that displays the time in this electronic timepiece 1 is configured with a second hand 4, a minute hand 5, a hour hand 6, and a date wheel 7.

Circuit Configuration of the Electronic Timepiece

Figure 2:
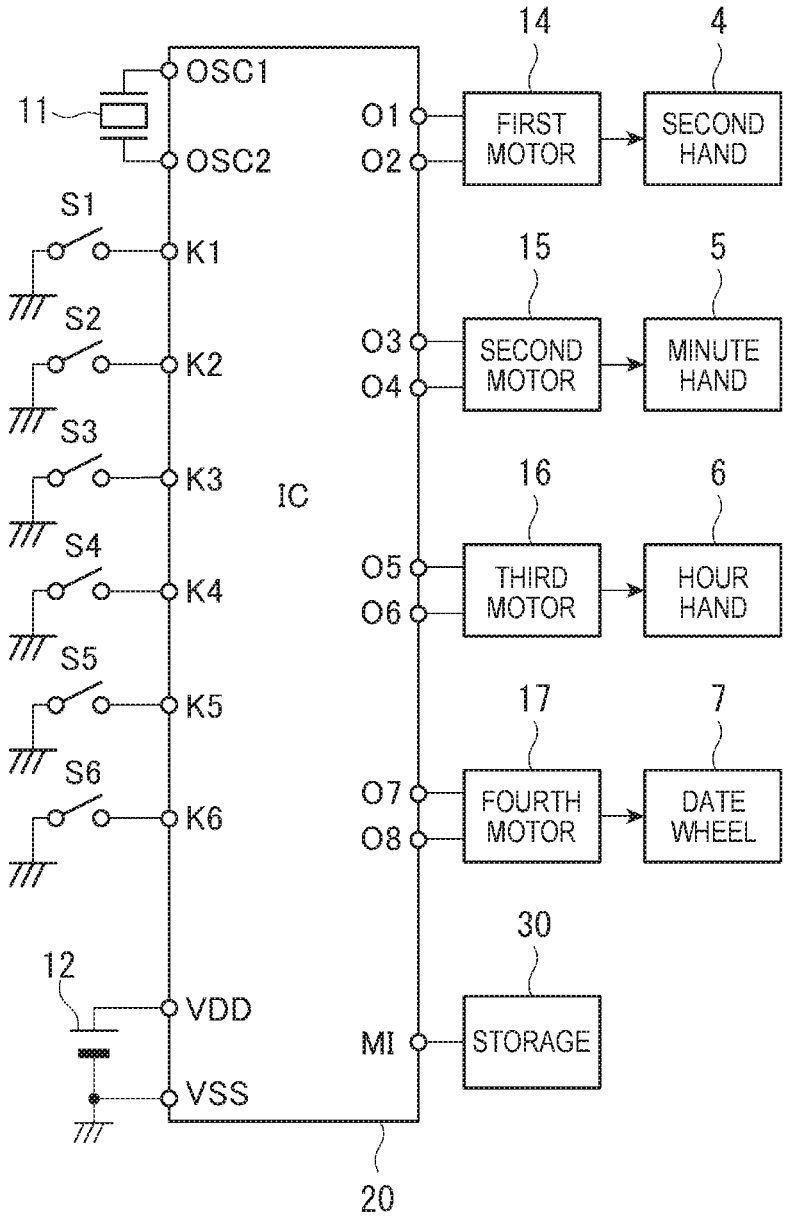
FIG. 2 illustrates the configuration of the movement in the first embodiment.
Figure 3:
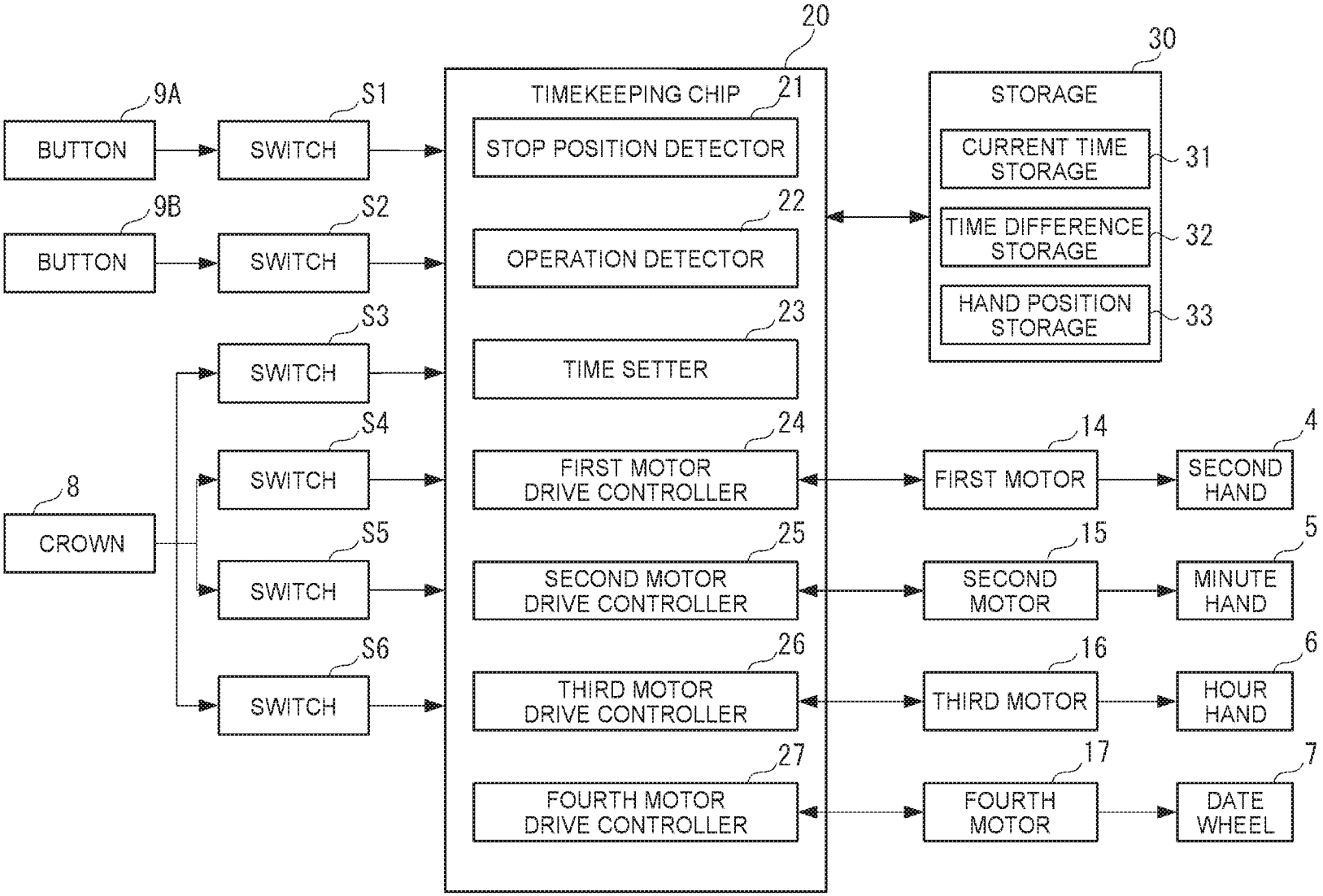
FIG. 3 is a block diagram illustrating the configuration of the movement in the first embodiment.

As shown in FIG. 2 and FIG. 3, the movement of the electronic timepiece 1 includes a crystal oscillator 11 as a signal source, a battery 12 as a power source, a first motor 14, a second motor 15, a third motor 16, a fourth motor 17, a timekeeping chip 20, and storage 30.

The movement includes switch S1 and switch S2 that turn on and off in response to operation of the button 9A and button 9B; switch S3 and switch S4 that turn on and off in response to operation of the crown 8; and switch S5 and switch S6 that turn on and off in response to rotation of the crown 8.

The first motor 14, second motor 15, third motor 16, and fourth motor 17 are two-pole single-phase stepper motors for an electronic timepiece, and are configured to enable moving the second hand 4, minute hand 5, hour hand 6, and date wheel 7 in both clockwise and counterclockwise directions. Note that because the second hand 4 typically requires fewer steps than the minute hand 5 and hour hand 6 to move one revolution, the first motor 14 may be configured to move the second hand 4 only clockwise.

As shown in FIG. 2, the timekeeping chip 20 has connection terminals OSC1 and OSC2 to which the crystal oscillator 11 is connected, input terminals K1, K2, K3, K4, K5, K6 to which the switches S1, S2, S3, S4, S5, S6 are connected, power supply terminals VDD and VSS to which the battery 12 is connected, output terminals O1 to O8 connected to the coils of the first motor 14 to fourth motor 17, and an input/output terminal M1 to which the storage 30 is connected.

Note that in this embodiment the positive terminal of the battery 12 connects to the power supply terminal VDD on the high potential side, the negative terminal connects to the power supply terminal VSS on the low potential side, and the power supply terminal VSS on the low potential side is set to ground.

The crystal oscillator 11 is driven by an oscillation circuit 21 described below, and outputs an oscillation signal.

The battery 12 may be a primary battery or a storage battery. If the battery 12 is a storage battery, it may be charged by a solar cell not shown, for example.

Switch S1 in this example is a push switch that operates in conjunction with operation of the button 9A disposed near the 2:00 position of the electronic timepiece 1, turns on when the button 9A is depressed, and is off when the button 9A is not depressed.

Switch S1 is a push switch that operates in conjunction with operation of the button 9B disposed near the 4:00 position of the electronic timepiece 1, turns on when the button 9B is depressed, and is off when the button 9B is not depressed.

Switches S3 and S4 are slide switches that operate in conjunction with the crown 8 being pulled out. In this embodiment the crown 8 is configured so that it can be pulled from the 0 stop at the normal initial position to a first stop, which is an example of a first position, and a second stop, which is an example of a second position. When the crown 8 is pulled out to the first stop, switch S3 is on and switch S4 is off; when at the second stop, switch S4 is on and switch S3 is off; and when at the 0 stop, switch S3 and switch S4 are both off.

Switches S5 and S6 are switches that operate in conjunction with rotation of the crown 8. In this embodiment, when the crown 8 is turned in the direction of 12:00, that is, when turned in the first direction R1 shown in FIG. 1, switch S5 turns intermittently on in response to the amount of crown 8 rotation. Rotation of the crown 8 in the direction in which the switch S5 turns on is referred to herein as forward rotation.

When the crown 8 is turned in the direction of 6:00, that is, when turned in the second direction R2 shown in FIG. 1, switch S6 turns intermittently on in response to the amount of crown 8 rotation. Rotation of the crown 8 in the direction in which the switch S6 turns on is referred to herein as reverse rotation.

The timekeeping chip 20 can detect the direction and amount of crown 8 rotation, that is, how much the crown 8 is turned by the user, based on the number of times switch S5 and switch S6 turn on.

As shown in FIG. 3, the timekeeping chip 20 includes a stop position detector 21, a operation detector 22, a time setter 23, a first motor drive controller 24, a second motor drive controller 25, a third motor drive controller 26, and a fourth motor drive controller 27.

The storage 30 includes current time storage 31 for storing current time information, time difference storage 32 for storing the set time difference, and hand position storage 33 for storing the positions of the second hand 4, minute hand 5, hour hand 6, and date wheel 7 of the time display unit 10.

The stop position detector 21 detects the stop of the crown 8 based on the states of switches S3 and S4.

The operation detector 22 detects whether or not the crown 8 is turned in the forward rotation or reverse rotation direction based on the states of switches S5 and S6, and determines the crown 8 was turned if there is input from switch S5 or switch S6, that is, the switch S5 or S6 is on. The operation detector 22 also detects whether or not button 9A and button 9B were pressed based on the states of switches S1 and S2.

When the stop position of the crown 8 detected by the stop position detector 21 is the first stop, which is an example of a first position, or the second stop, which is an example of a second position, and the operation detector 22 detects rotation of the crown 8, the time setter 23 adjusts the time difference stored in the time difference storage 32 based on the adjustment amount determined according to the stop position of the crown 8.

In this embodiment, the time setter 23 sets one hour as the adjustment amount when the stop position of the crown 8 is the first position, sets 15 minutes as the adjustment amount when the stop position is the second position, and adjusts the time difference stored in the time difference storage 32 according to the rotation of the crown 8.

In this embodiment, when the operation detector 22 detects input from the switch S5 or switch S6, and within a specific unit of time detects input from the switch again, the time setter 23 adjusts the time difference by the adjustment amount corresponding to a single input. The unit of time is a previously set time such as one second in this example, and is set according to the average operating time required to turn the crown 8 once, for example.

As a result, if there is input from switch S5 or switch S6 once or more, such as twice, within the unit of time, the time setter 23 adjusts the time difference the adjustment amount appropriate to one rotation of the crown 8 at the detected stop position, that is, one hour or 15 minutes. In addition, if input is detected again after the specific unit of time has past after input from the switch S5 or S6 is detected, the time setter 23 recognizes another input, and again adjusts the time difference by the adjustment amount corresponding to one input.

The reason the time setter 23 determines there is one input within the specific unit of time is described below.

More specifically, when the user turns the crown 8 once, the angle of rotation the crown 8 turns may differ according to the user, for example. As a result, the switch S5 or switch S6 may turn on two or more times even though the user intended to turn the crown 8 only once. If the time difference is adjusted simply according to the number of times the switch S5 and S6 turns on, the time difference may be adjusted two hours or more, for example, according to rotation of the crown 8 even though the user only intended to adjust the time difference one hour. Conversely, if the user turns the crown 8 once and then turns the crown 8 again, the user may need to release and grip the crown 8 again, and this requires time. Therefore, if a single operation is determined within the specific unit of time, the time setter 23 can adjust the time difference the adjustment amount corresponding to a single rotation of the crown 8, and the time difference can be easily adjusted as intended by the user.

Note that if there is input from switch S5 and input from switch S6 within the unit of time, the time setter 23 may determine that the last switch input is valid. For example, if the crown 8 is at the first stop, switch S5 inputs first, and then switch S6 inputs, the input from switch S6 may be determined to be valid and the time difference reduced one hour.

When the time difference is adjusted, the time setter 23 adjusts the current time stored in the current time storage 31, operates the motor drive controllers 24 to 27 to indicate the adjusted current time, and adjusts the time indicated by the time display unit 10. In this operation the time setter 23 updates the hand positions stored in the hand position storage 33 according to the drive pulses of the motor drive controllers 24 to 27 so that the hand position data stored in the hand position storage 33 tracks the positions indicated by the second hand 4, minute hand 5, hour hand 6, and date wheel 7.

The current time in the current time storage 31 is updated by a reference signal that frequency divides the oscillation signal of the crystal oscillator 11. Until the time currently indicated by the second hand 4, minute hand 5, hour hand 6, and date wheel 7, that is, the hand positions of the hand position storage 33, match the current time in the current time storage 31, the time setter 23 continues operating the motor drive controllers 24 to 27 and rapidly advances the second hand 4, minute hand 5, hour hand 6, and date wheel 7 to the positions indicating the current time.

The manual time difference adjustment modes enabling the user to manually adjust the time difference by pulling out and turning the crown 8 is described next with reference to FIG. 4 to FIG. 6.

Note that the time difference stored in the time difference storage 32 of the storage 30 is information reflecting the time zone of the current location, and can be previously set by such methods as described below.

For example, an electronic timepiece capable of receiving signals from GPS satellites and acquiring positioning information for the current location based on the received signals may store time zone data corresponding to the acquired positioning information, or more specifically the time difference to UTC, as the time difference.

First Manual Time Difference Adjustment Mode

Figure 4:
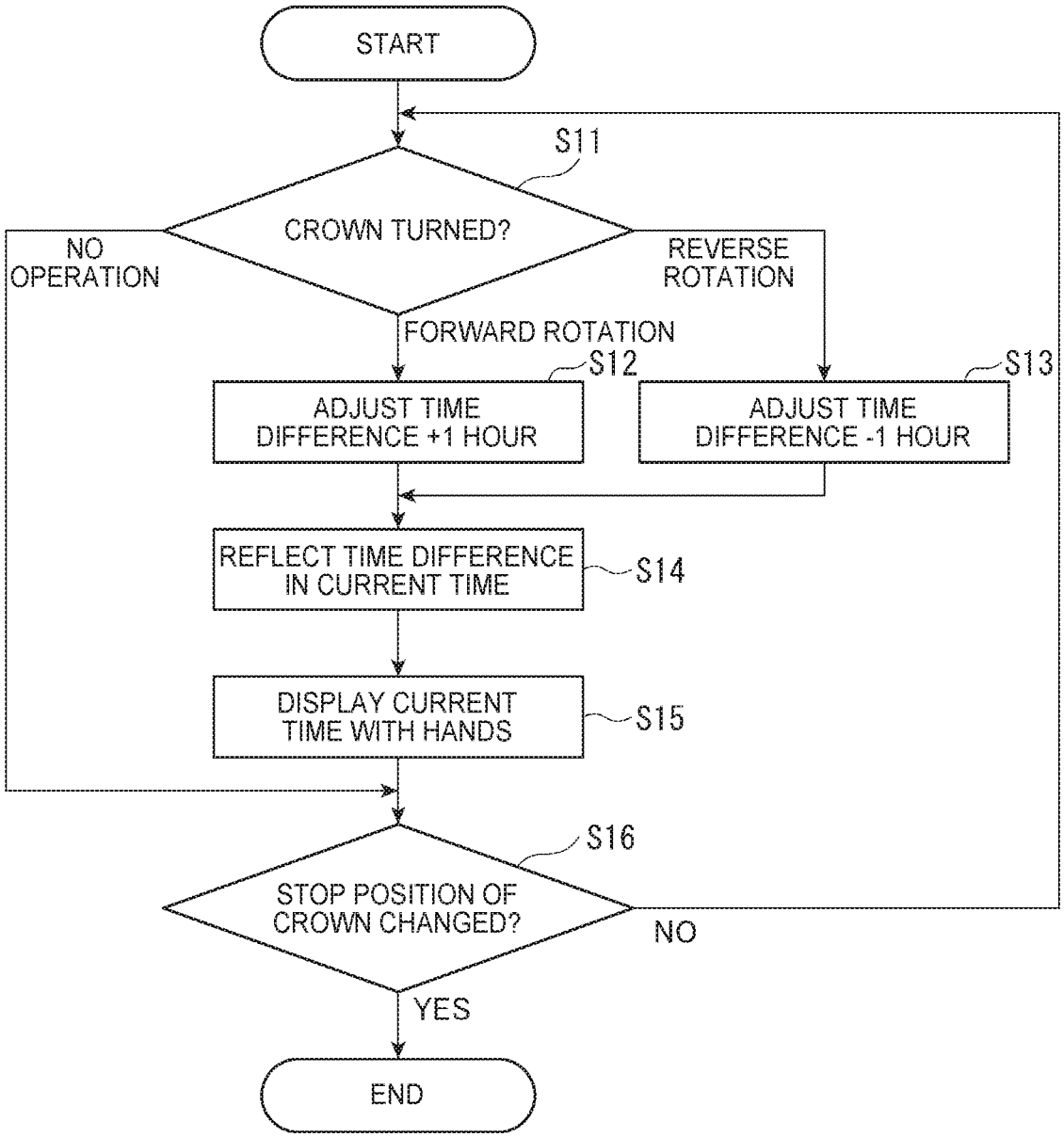
FIG. 4 is a flow chart describing operation in a first manual time difference adjustment mode.

FIG. 4 is a flow chart of the first manual time difference adjustment mode executed when the crown 8 is pulled out to the first stop, which is an example of a first position.

When the stop position detector 21 detects that the crown 8 was pulled out to the first stop, which is an example of a first position, the time setter 23 starts the control process shown in FIG. 4, and executes step S11 to determine if the crown 8 was turned. In step S11 the time setter 23 determines, based on the detection result from the operation detector 22, if the crown 8 was turned forward, turned in reverse, or was not turned.

If the time setter 23 determines in step S11 that the crown 8 was turned forward, the time setter 23 executes step S12 to adjust the time difference stored in the time difference storage 32 +1 hour.

If the time setter 23 determines in step S11 that the crown 8 was turned in reverse, the time setter 23 executes step S13 to adjust the time difference stored in the time difference storage 32 −1 hour.

Next, the time setter 23 executes step S14 to reflect the current time stored in the current time storage 31 in the time difference stored in the time difference storage 32. As a result, after step S12 executes +1 hour is added to the current time stored in the current time storage 31, and after step S13 executes −1 hour is added to, that is, one hour is subtracted from, the current time stored in the current time storage 31. For example, if the current time before the time difference is adjusted is 10:08:43, the current time after a time difference of +1 is reflected is 11:08:43, and the current time after a time difference of −1 is reflected is 09:08:43.

Next, the time setter 23 executes step S15 to indicate the current time by the hands. More specifically, the time setter 23 outputs a drive signal to the third motor 16 to move +1 hour, or outputs a drive signal to move −1 hour, and moves the hour hand 6 +1 hour or −1 hour.

Figure 6:
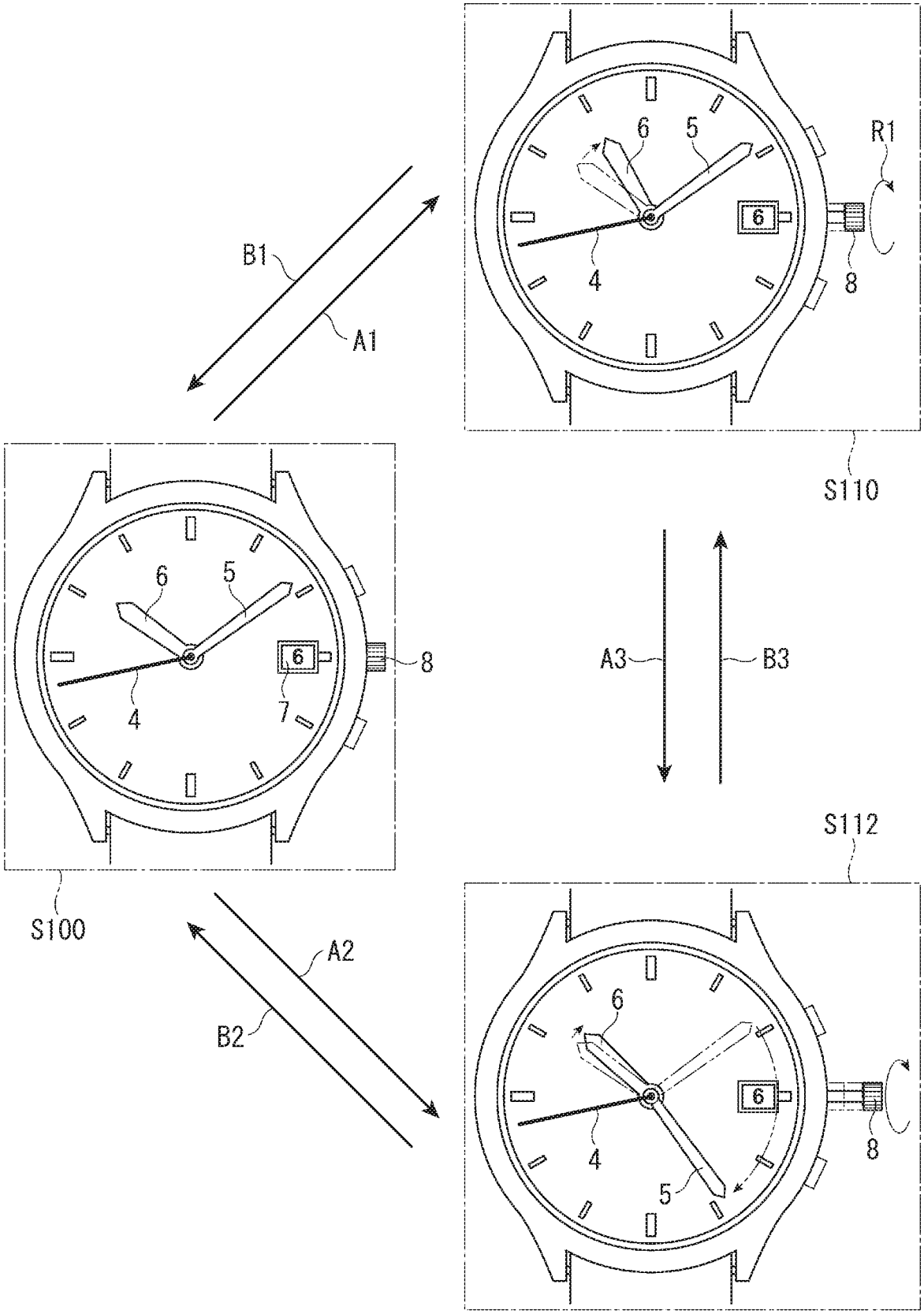
FIG. 6 shows an example of operation when manually adjusting the time difference in the first embodiment.

For example, if the crown 8 is at the 0 stop and the second hand 4, minute hand 5, hour hand 6, and date wheel 7 are indicating the standard time as shown in S100 in FIG. 6, the crown 8 is then pulled out to the first stop and turned forward, the hour hand 6 moves +1 hour as shown in S110 in FIG. 6. The second hand 4 and minute hand 5 continue to indicate the second and minute of the current time.

Note that in this operation the second hand 4 may be moved to and stopped at a previously set position, such as the 40 second position, to indicate operation in the first manual time difference adjustment mode.

The drive signal output to the third motor 16 is also output to the hand position storage 33, and the hand position data in the hand position storage 33 is also updated.

The time setter 23 executes step S16 after executing step S15, and determines based on the states of switches S3 and S4 whether or not the stop position of the crown 8 changed.

If the time setter 23 does not detect rotation of the crown 8 in step S11, that is, if there was no input from switches S5 and S6 and no operation of the crown 8 was detected in step S11, the time setter 23 executes step S16. If the time setter 23 determines NO in step S16, the time setter 23 returns to step S11, and if YES is determined in step S16, the first manual time difference adjustment mode ends.

In this event, if the crown 8 has been pushed in to the 0 stop position by the user, the time setter 23 resumes the normal time display mode as shown in S100 in FIG. 6.

If it is determined that the crown 8 was pulled out by the user to the second stop, the time setter 23 executes the second manual time difference adjustment mode described next.

Second Manual Time Difference Adjustment Mode

Figure 5:
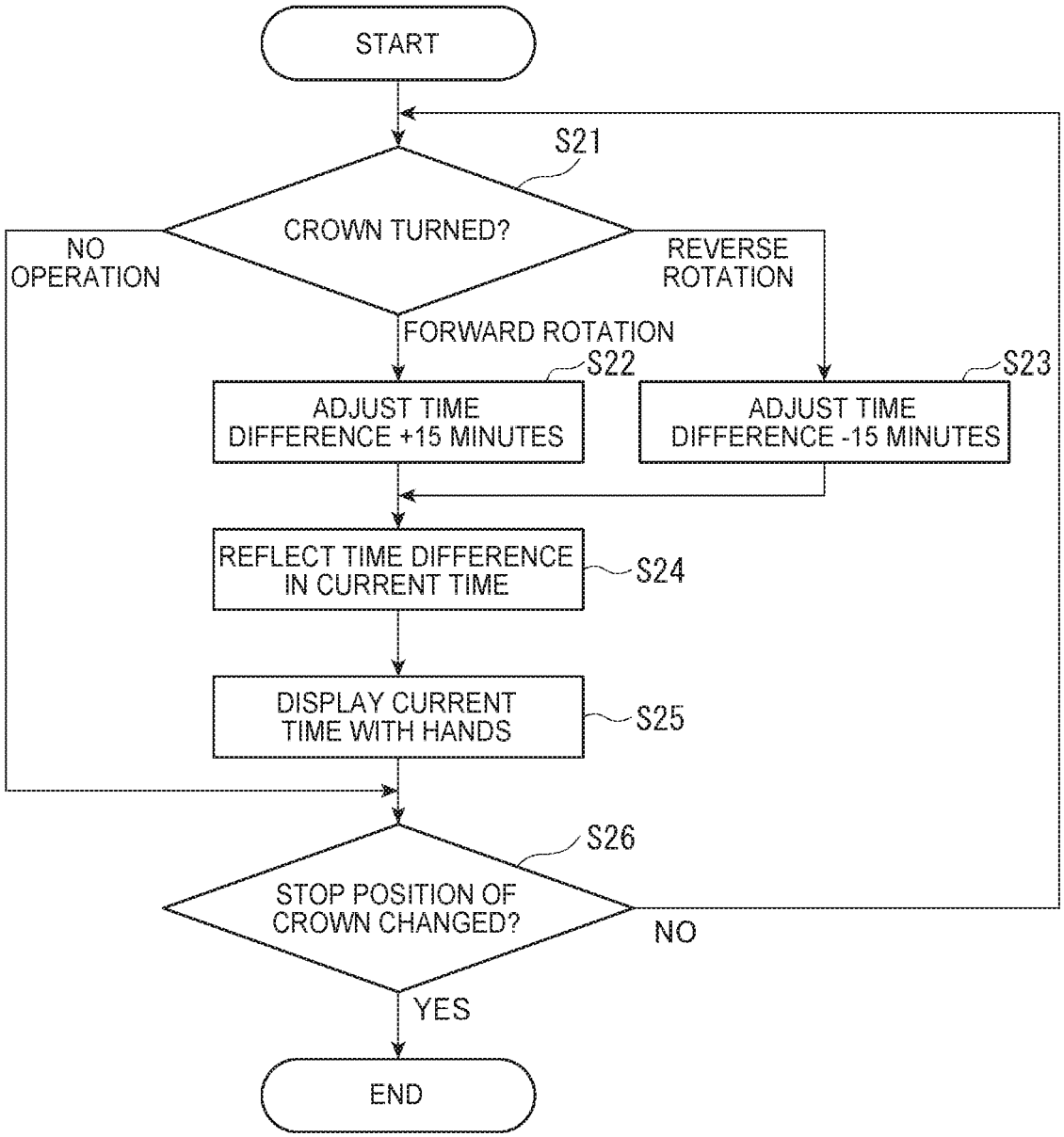
FIG. 5 is a flowchart describing operation in a second manual time difference adjustment mode.

FIG. 5 is a flow chart of the second manual time difference adjustment mode executed when the crown 8 is pulled out to the second stop, which is an example of a second position.

When the stop position detector 21 detects that the crown 8 was pulled out to the second stop, which is an example of a second position, the time setter 23 starts the control process shown in FIG. 5, and executes step S21 to determine if the crown 8 was turned. In step S21 the time setter 23 determines, by checking the input states of switches S5 and S6, if the crown 8 was turned forward, turned in reverse, or was not turned.

If the time setter 23 determines in step S21 that the crown 8 was turned forward, the time setter 23 executes step S22 to adjust the time difference stored in the time difference storage 32 +15 minutes.

If the time setter 23 determines in step S21 that the crown 8 was turned in reverse, the time setter 23 executes step S23 to adjust the time difference stored in the time difference storage 32 −15 minutes.

Next, the time setter 23 executes step S24 to reflect the current time stored in the current time storage 31 in the time difference stored in the time difference storage 32. As a result, after step S22 executes +15 minutes is added, and after step S23 executes −15 minutes is added to, that is, fifteen minutes is subtracted from, the current time stored in the current time storage 31.

For example, if the current time before the time difference is adjusted is 10:08:43, the current time after a time difference adjustment of +15 minutes is reflected is 10:23:43, and the current time after a time difference adjustment of −15 minutes is reflected is 09:53:43.

Next, the time setter 23 executes step S25 to indicate the current time with the hands. Note that when the minute hand 5 is moved in +/−15 increments, the hour hand 6 must normally also be moved. As a result, the time setter 23 outputs drive signals to the second motor 15 and third motor 16 to move +15 minutes, or outputs drive signals to move −15 minutes, and moves the minute hand 5 and hour hand 6 the angle of rotation corresponding to +15 minutes or −15 minutes.

For example, if the crown 8 is pulled out to the second stop and turned forward, the minute hand 5 is moved +15 minutes from the normal time display state shown in S110 in FIG. 6, and the hour hand 6 is moved 30 degrees×¼=7.5 degrees as shown in S120 in FIG. 6. At this time the second hand 4 continues displaying the second of the current time. Note that the second hand 4 may be moved and stopped at a predetermined position, such as the 50 second position, to indicate the second time difference adjustment mode.

The drive signals output to the second motor 15 and third motor 16 are also output to the hand position storage 33, and the hand position data in the hand position storage 33 is updated.

After executing step S25, the time setter 23 then executes step S26 to determine based on the states of switches S3 and S4 whether or not the stop position of the crown 8 was changed.

If the time setter 23 determined in step S21 that the crown 8 was not turned, or more specifically determines there is no input from switches S5 and S6 and determines in step S21 the crown 8 was not operated, the time setter 23 executes step S26.

If the time setter 23 determines NO in step S26, the time setter 23 returns to step S21 and continues the control process. If the time setter 23 YES in step S26, the time setter 23 ends the second manual time difference adjustment mode.

Note that in both the first manual time difference adjustment mode and the second manual time difference adjustment mode, if the time is adjusted such that the date also changes, the time setter 23 also operates the fourth motor 17 to move the date wheel 7. More specifically, if the crown 8 is turned forward from the state with a time difference of UTC +14 hours, or the crown 8 is turned in reverse from the state with a time difference of UTC −12 hours, the time setter 23 also moves the date wheel 7.

Note that in FIGS. 6 A1 to A3 and B1 to B3 indicate a change in the stop position of the crown 8. More specifically, A1 indicates an operation changing the crown 8 from the 0 stop to stop 1, A2 indicates an operation changing the crown 8 from the 0 stop to stop 2, and A3 indicates an operation changing the crown 8 from stop 1 to stop 2. B1 indicates an operation changing the crown 8 from stop 1 to stop 0, B2 indicates an operation changing the crown 8 from stop 2 to stop 0, and B3 indicates an operation changing the crown 8 from stop 2 to stop 1.

Effect of Embodiment 1

In the first embodiment the time difference can be increased or decreased in 1 hour increments when the crown 8 is pulled out to the first stop, which is an example of a first position, and then turned forward or reverse, and the time difference can be increased or decreased in 15 minute increments when the crown 8 is pulled out to the second stop, which is an example of a second position, and then turned forward or reverse.

The amount the time difference is adjusted is therefore uniform according to the stop position of the crown 8, the operation for setting the time difference is also uniform based on the forward or reverse rotation of the crown 8, the user can set the time difference intuitively, and operability can be improved.

Furthermore, because the time difference can be adjusted using only the crown 8, the time difference can be adjusted even in an electronic timepiece that does not have buttons 9A and 9B.

Furthermore, because the electronic timepiece 1 also has a second manual time difference adjustment mode for adjusting the time difference in 15 minute increments according to the stop position of the crown 8, the time difference can be set appropriately to the time difference of the time zone currently used in any country in the world. In addition, because the electronic timepiece 1 also has a first manual time difference adjustment mode for adjusting the time difference in 1 hour increments, the time difference can be set appropriately with minimal operations in conjunction with the second manual time difference adjustment mode.

Furthermore, because the time difference stored in the time difference storage 32 is adjusted instead of directly adjusting the current time stored in the current time storage 31, the time difference can be easily adjusted to the time corresponding to the time zone used in any country. Yet further, because the date wheel 7 is also automatically moved and the displayed date is adjusted if the time difference is adjusted such that the date also changes, operability is improved compared with a configuration requiring manually moving the date wheel 7.

Embodiment 2

An electronic timepiece 1A according to the second embodiment is described next.

Figure 7:
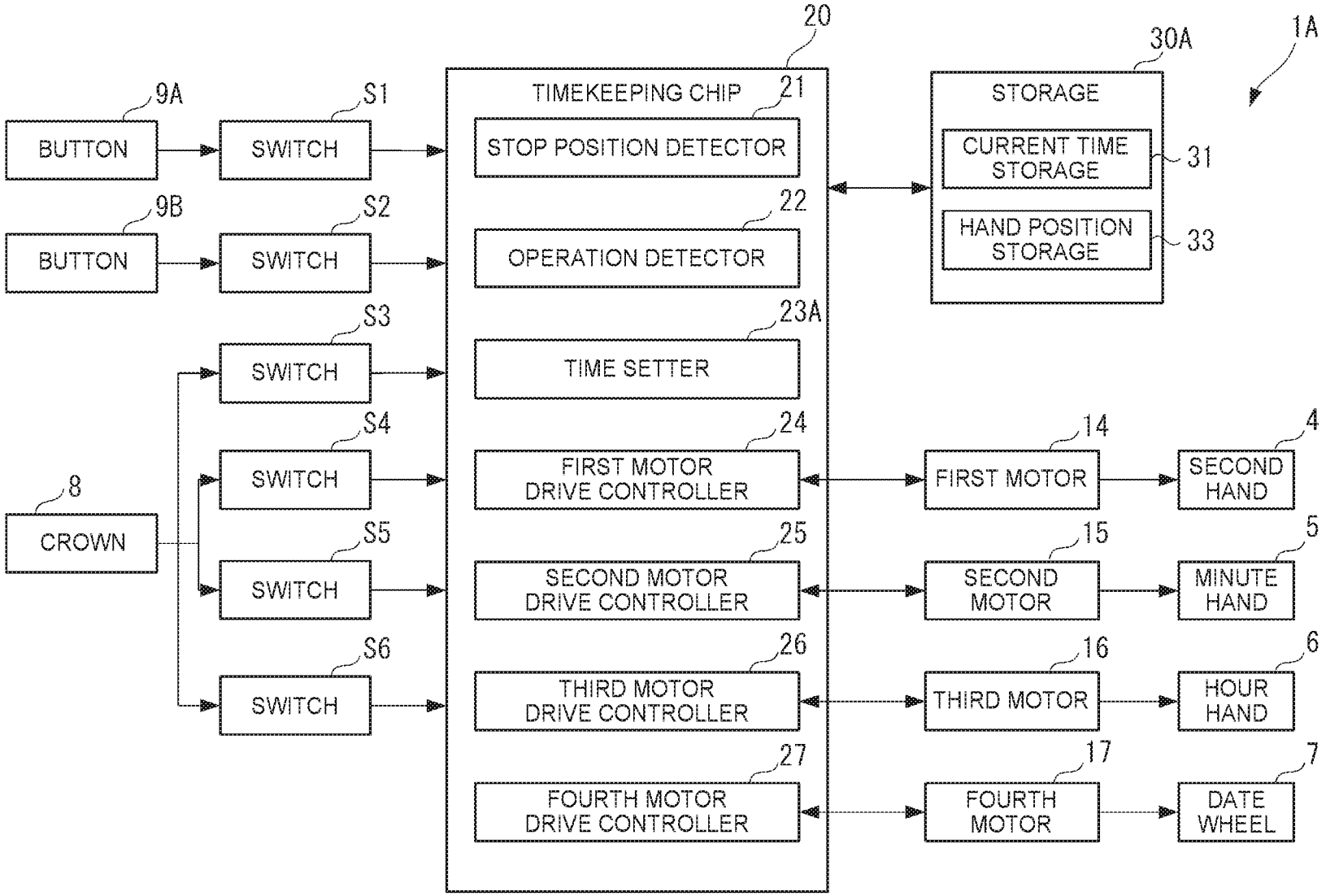
FIG. 7 is a block diagram illustrating the configuration of the movement in a second embodiment.

The electronic timepiece 1A according to the second embodiment differs from the first embodiment in that the current time is set by operating buttons 9A and 9B. As a result, the configuration of the electronic timepiece 1A differs from the first embodiment in having a time setter 23A and storage 30A as shown in FIG. 7. Note that other aspects of the configuration of the electronic timepiece 1A are the same as the electronic timepiece 1 described above, therefore identified by the same reference numerals, and further description thereof is omitted.

When the crown 8 is at the first stop or second stop, the time setter 23A adjusts the current time according to operation of the buttons 9A and 9B. As described in the first embodiment, the time setter 23A determines there is only one button operation when multiple button operations are executed within a specific unit of time. However, unlike rotation of the crown 8, the number of times the buttons 9A and 9B are operated does differ between users. As a result, the time setter 23A may eliminate the unit of time limitation on the number of times the buttons 9A and 9B are operated, and set the adjustment of the current time based only on the number of times the buttons 9A and 9B are operated.

The storage 30A in this embodiment includes current time storage 31 and hand position storage 33, and does not have time difference storage 32.

The time setter 23A of the electronic timepiece 1A executes a first current time adjustment mode and a second current time adjustment mode.

The first current time adjustment mode is a mode that advances or sets back the current time one hour when the crown 8 is at the first stop and button 9A or button 9B is operated.

The second current time adjustment mode is a mode that advances or sets back the current time one minute when the crown 8 is at the second stop and button 9A or button 9B is operated.

The current time adjustment modes in this embodiment are described below with reference to FIG. 8 to FIG. 10.

First Current Time Adjustment Mode

Figure 8:
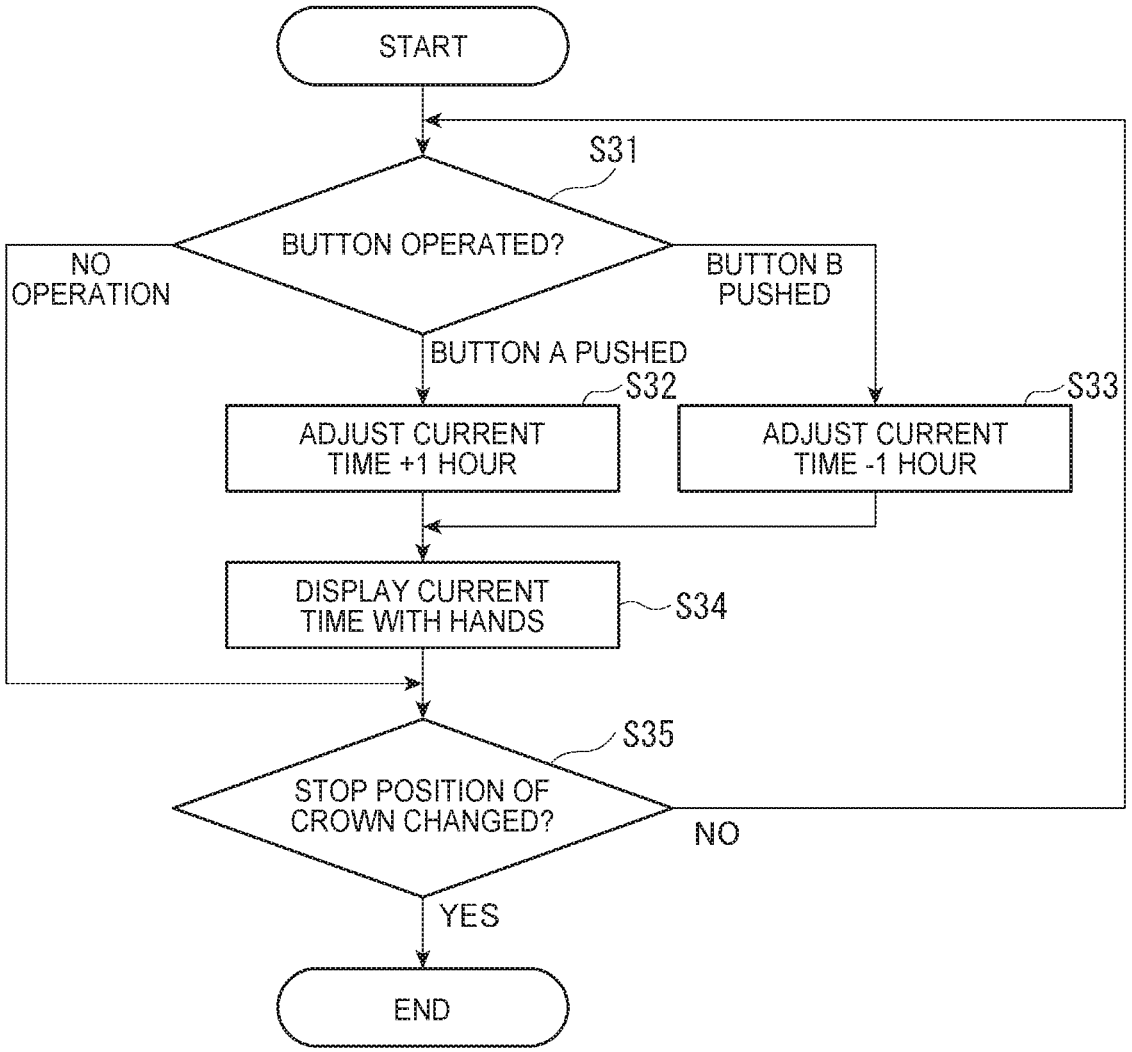
FIG. 8 is a flow chart of a first current time adjustment mode in the second embodiment.

FIG. 8 is a flowchart showing the process of the first current time adjustment mode that is executed when the crown 8 is pulled out to the first stop, which is an example of a first position.

When the stop position detector 21 detects that the crown 8 was pulled out to the first stop, which is an example of a first position, the time setter 23A starts the control process shown in FIG. 8, and executes step S31 to determine if button 9A or button 9B was pushed. In step S31 the time setter 23A can determine, based on the detection result from the operation detector 22, if button 9A or button 9B was operated, or neither button was operated.

If the time setter 23A determines in step S31 that button 9A was pushed, the time setter 23A executes step S32 to adjust the current time+1 hour.

If the time setter 23A determines in step S31 that button 9B was pushed, the time setter 23A executes step S33 to adjust the current time −1 hour.

When the time setter 23A executes step S32 or S33, the time setter 23A also adjusts the current time stored in the current time storage 31.

Next, the time setter 23A executes step S34 to indicate the current time by the hands. More specifically, the time setter 23A outputs a drive signal to the third motor 16 to move +1 hour, or outputs a drive signal to move −1 hour, and moves the hour hand 6 +1 hour or −1 hour.

Figure 10:
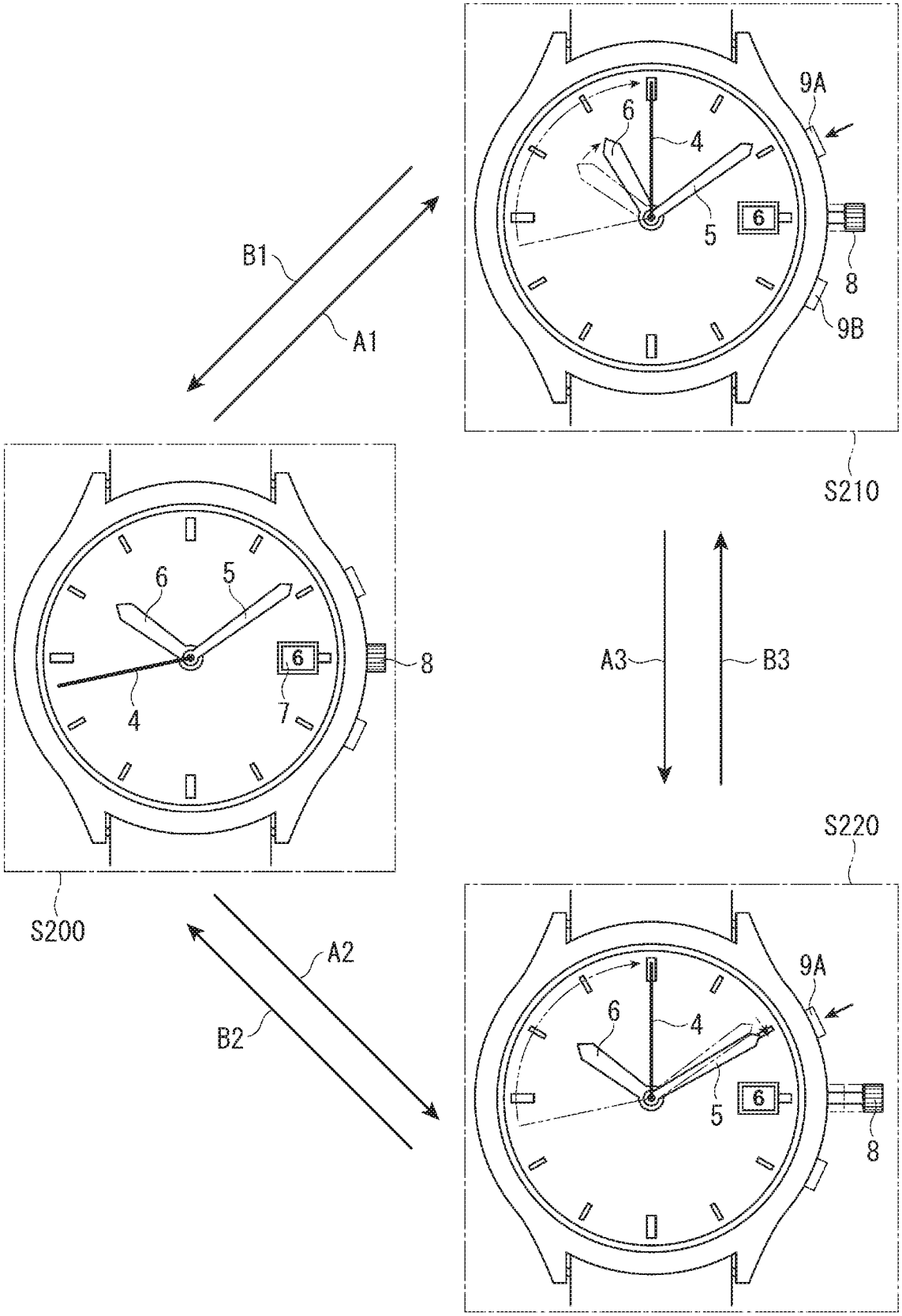
FIG. 10 shows an example of operation when adjusting the current time in the second embodiment.

For example, if the crown 8 is at the 0 stop and the second hand 4, minute hand 5, hour hand 6, and date wheel 7 are indicating the current time as shown in S200 in FIG. 10, the crown 8 is then pulled out to the first stop and button 9A is pushed, the hour hand 6 moves +1 hour as shown in S210 in FIG. 10.

In this event, the minute hand 5 continues to indicate the minute of the current time, and the second hand 4 moves to and stops at a predetermined position, such as the 00 second position, to indicate the current time adjustment mode.

The drive signal output to the third motor 16 is also output to the hand position storage 33, and the hand position data in the hand position storage 33 is also updated.

The time setter 23A executes step S35 after executing step S34, and determines based on the states of switches S3 and S4 whether or not the stop position of the crown 8 changed.

The time setter 23A also executes step S35 when operation of the buttons 9A and 9B is not detected in step S31, that is, when there is no input from switches S1 and S2 and the time setter 23A determines in step S31 that no button was operated.

The time setter 23A returns the control process to step S31 when it determines NO in step S35, but the time setter 23A ends the first current time adjustment mode if it determines YES in step S35.

In this event, if the crown 8 is pushed in to the 0 stop by the user, the time setter 23A returns to the normal time display mode as shown in S200 in FIG. 10.

However, if the user pulled the crown 8 out to the second stop, the time setter 23A executes the second current time adjustment mode.

Second Current Time Adjustment Mode

Figure 9:
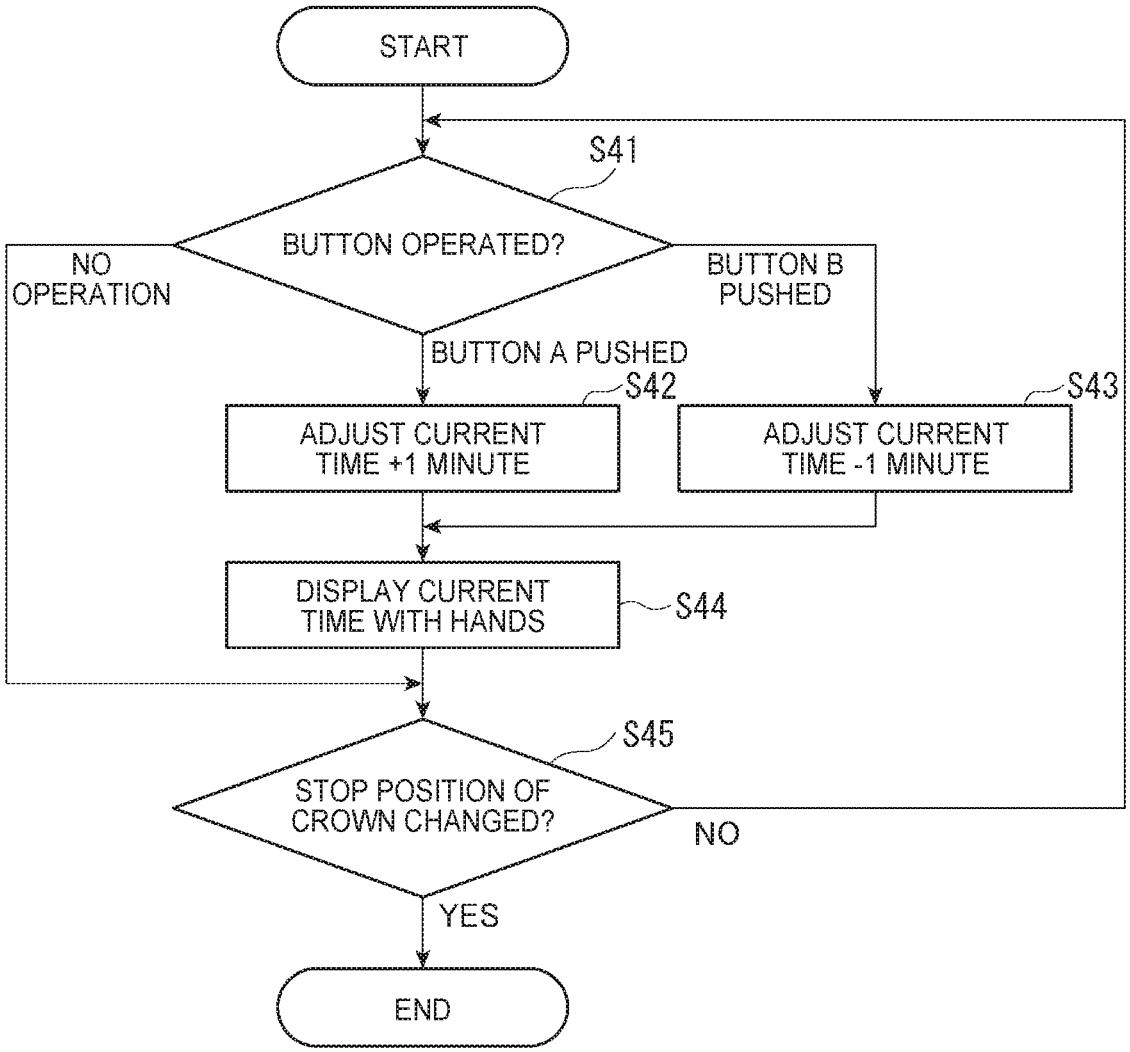
FIG. 9 is a flow chart of a second current time adjustment mode in the second embodiment.

FIG. 9 is a flow chart showing the process of the second current time adjustment mode that is executed when the crown 8 is pulled out to the second stop, which is an example of a second position.

When the stop position detector 21 detects that the crown 8 was pulled out to the second stop, which is an example of a second position, the time setter 23A starts the control process shown in FIG. 9, and executes step S41 to determine if button 9A or button 9B was pushed. In step S41 the time setter 23A can determine, based on the detection result from the operation detector 22, if button 9A or button 9B was operated, or neither button was operated.

If the time setter 23A determines in step S41 that button 9A was pushed, the time setter 23A executes step S42 to adjust the current time+1 minute.

If the time setter 23A determines in step S41 that button 9B was pushed, the time setter 23A executes step S43 to adjust the current time −1 minute.

When the time setter 23A executes step S42 or S43, it also adjusts the current time stored in the current time storage 31.

Next, the time setter 23A executes step S44 to indicate the current time by the hands. More specifically, the time setter 23A outputs a drive signal to the third motor 16 to move +1 minute, or outputs a drive signal to move −1 minute, and moves the minute hand 5 +1 minute or −1 minute.

For example, if the crown 8 is at the 0 stop and the second hand 4, minute hand 5, hour hand 6, and date wheel 7 are indicating the current time as shown in S200 in FIG. 10, the crown 8 is then pulled out to the second stop and button 9A is pushed, the minute hand 5 moves +1 minute as shown in S220 in FIG. 10.

In this event, the hour hand 6 continues to indicate the hour of the current time, and the second hand 4 moves to and stops at a predetermined position, such as the 00 second position, to indicate the current time adjustment mode.

Note that the hour hand 6 may be moved 30 degrees/60=0.5 degree each time the minute hand 5 is adjusted one minute, but because there is a separate third motor 16 for driving the hour hand 6, the hour hand 6 may be moved 5 degrees when the minute hand 5 moves 10 minutes, for example.

The drive signal output to the second motor 15 is also output to the hand position storage 33, and the hand position data in the hand position storage 33 is also updated.

The time setter 23A executes step S45 after executing step S44, and determines based on the states of switches S3 and S4 whether or not the stop position of the crown 8 changed.

The time setter 23A also executes step S45 when operation of button 9A or button 9B is not detected in step S41, that is, when there is no input from switches S1 and S2 and the time setter 23A determines in step S41 that no button was operated.

The time setter 23A returns the control process to step S41 when it determines NO in step S45, but the time setter 23A ends the second current time adjustment mode if it determines YES in step S45.

Reference numerals A1 to A3 and B1 to B3 in FIG. 10 indicate changing the stop position of the crown 8 as described in FIG. 6, and further description thereof is omitted.

Effect of Embodiment 2

When the user of the electronic timepiece 1A adjusts the current time indicated by the second hand 4, minute hand 5, hour hand 6, and date wheel 7 in the second embodiment, the user can set how much to adjust the current time, that is, the adjustment amount, according to the stop position of the crown 8, and can select whether to advance or reverse the current time setting by operating the buttons 9A and 9B.

More specifically, the user can change the value of the adjustment amount of the current time by changing the stop position of the crown 8, and whether the adjustment amount is set to one hour or one minute, the current time can be advanced, that is, the adjustment amount can be added to the current time, by pushing button 9A, and the current time can be set back, that is, the adjustment amount can be subtracted from the current time, by pushing button 9B.

The amount the time difference is adjusted is therefore unified according to the stop position of the crown 8, and the operation for adding the adjustment amount to or subtracting the adjustment amount from the current time is unified according to the operation of buttons 9A and 9B. Operation is therefore easier for the user to understand, operability can be improved, and operating errors can be prevented.

Because different buttons 9A and 9B are used for the operations of advancing and reversing the current time setting, the chance of the user pushing the wrong button is reduced, the operating feel is uniform, the user can intuitively adjust the current time, and operability can be improved.

Because the time is adjusted in this electronic timepiece 1A by an operation changing the stop position of the crown 8 and a push operation of the buttons 9A and 9B, there is no need to turn the crown 8. As a result, the current time can be adjusted even in an electronic timepiece that does not have switches S5 and S6 for detecting rotation of the crown 8.

Because the electronic timepiece 1A has a second current time adjustment mode for adjusting the current time in 1 minute increments according to the stop position of the crown 8, the current time can be easily adjusted when setting the displayed time according to a time announcement, for example.

Furthermore, because the electronic timepiece 1A has a first current time adjustment mode for adjusting the current time in 1 hour increments, the current time can be easily adjusted with minimal operations in conjunction with the second current time adjustment mode.

The invention is not limited to the embodiments described above, and can be varied in many ways without departing from the scope of the accompanying claims.

The electronic timepiece 1 according to the first embodiment adjusts the time difference by turning the crown 8, but the time difference may be adjusted by operating the buttons 9A and 9B as in the second embodiment.

Likewise, the electronic timepiece 1A according to the second embodiment adjusts the current time by pushing the buttons 9A and 9B, but the current time may be adjusted by rotation of the crown 8 as in the first embodiment.

An electronic timepiece according to the invention is not limited to analog timepieces that indicate the time with hands, and may be a digital timepiece or a combination timepiece having both hands and a digital display. The timepiece may also be a timepiece having an antenna and receiver chip for receiving and processing satellite signals or standard time signals.

Figure 11:
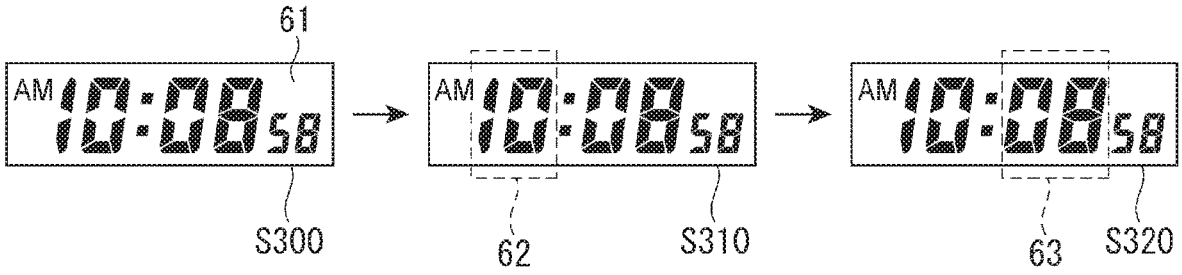
FIG. 11 shows an example of time adjustment in another embodiment.

The target of the operation of the operating members is also not limited to the time difference or current time. For example, in an electronic timepiece having an alarm or timer function, the alarm time or the timer setting may be set by similar operating members. FIG. 11 shows an example of setting the alarm time in a digital timepiece.

S300 in FIG. 11 shows an example of the normal time display when the current time is displayed on a digital display 61.

Because the adjustment amount is one hour when the crown 8 is pulled out to the first stop in this example, the hour indicator 62 in the digital display 61 flashes as shown in S310 in FIG. 11 to indicate that the hour is selected for adjustment. When the crown 8 is then turned forward or reverse, or button 9A or button 9B is pushed, one hour is added to or subtracted from the hour displayed in the hour indicator 62, and the alarm time is adjusted.

Because the adjustment amount is one minute when the crown 8 is pulled out to the second stop in this example, the minute indicator 63 in the digital display 61 flashes as shown in S320 in FIG. 11 to indicate that the minute is selected for adjustment. When the crown 8 is then turned forward or reverse, or button 9A or button 9B is pushed, one minute is added to or subtracted from the number displayed in the minute indicator 63, and the alarm time is adjusted.

Operation is also conceivable using operators other than the buttons 9A and 9B in the second embodiment. More specifically, operators other than the crown 8 are not limited to buttons 9A and 9B, and configurations having a rotatable bezel or an internal vibration sensor that detects taps, for example are conceivable. In addition, by incorporating an acceleration sensor to detect movement of the entire electronic timepiece, the entire electronic timepiece may be made to function as an operator.

The adjustment amount that is set according to the stop position of the crown 8 is not limited to the examples in the foregoing embodiments. For example, when a time zone changes and settings in 15 minute increments are not necessary, the adjustment amount may be set to 30 minutes when the stop position of the crown 8 is at the second position. The adjustment amount corresponding to the stop position of the crown 8 may also be set according to the type of time to be adjusted.

The foregoing embodiments anticipate an electronic timepiece that can receive signals from GPS satellites, but the electronic timepiece may be an electronic timepiece that does not have the ability to acquire positioning information.

The foregoing embodiments also describe the time setter 23 also moving the date wheel 7 when the crown 8 is rotated forward from a state indicating a time difference of UTC +14, and when the crown 8 is rotated in reverse from a state indicating a time difference of UTC −12, but the invention is not so limited. For example, configurations enabling setting the time difference to a state indicating UTC +24 or a state indicating UTC −24 are also conceivable.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. An electronic timepiece comprising:

a case;

a time display configured to indicate the time, the case housing the time display;

a rotatable crown configured to be pulled away from the case to multiple stop positions, including a first stop position and a second stop position, the first stop position being a first distance away from the case and the second stop position being a second distance away from the case, the first distance being greater than zero and the second distance being greater than the first distance;

a stop position detector configured to detect a crown stop position of the crown, the crown stop position being one of the multiple stop positions;

an operation detector configured to detect an operation rotating the crown; and a time setter configured to change the time displayed by the time display according to an adjustment amount that differs according to the crown stop position at each detected operation when the stop position is the first stop position or the second stop position and the operating detector detects the operation, wherein the time setter is configured to change the time in first increments when the crown stop position is in the first stop position, and wherein the time setter is configured to change the time in second increments when the crown stop position is the second stop position, the second increments being different increments from the first increments.

2. The electronic timepiece described in claim 1, wherein:

the time setter sets the time by setting a time difference of the time displayed by the time display.

3. The electronic timepiece described in claim 2, wherein:

the first increments are one hour increments, and the second increments are fifteen minute increments.

4. The electronic timepiece described in claim 1, wherein:

the first increments are one hour increments, and the second increments are one minute increments.

5. An electronic timepiece comprising:

a case;

a time display configured to indicate the time, the case housing the time display;

a rotatable crown that can be pulled away from the case to multiple stop positions, including a first stop position and a second stop position, the first stop position being a first distance away from the case and the second stop position being a second distance away from the case, the first distance being greater than zero and the second distance being greater than the first distance;

an operator separate from the crown;

a stop position detector configured to detect a crown stop position of the crown, the crown stop position being one of the multiple stop positions;

an operation detector configured to detect an operation of the operator; and a time setter configured to change the time displayed by the time display according to an adjustment amount that differs according to the crown stop position at each detected operation when the crown stop position is the first stop position or the second stop position and the operating detector detects the operation, wherein the time setter is configured to change the time in first increments when the crown stop position is the first stop position, and wherein the time setter is configured to change the time in second increments when the crown stop position is the second stop position, the second increments being different increments from the first increments.

6. The electronic timepiece described in claim 5, wherein:

the time setter sets the time by setting a time difference of the time displayed by the time display.

7. The electronic timepiece described in claim 6, wherein:

the first increments are one hour increments, and the second increments are fifteen minute increments.

8. The electronic timepiece described in claim 5, wherein:

the first increments are one hour increments, and the second increments are one minute increments.

9. The electronic timepiece described in claim 5, wherein:

the operator is a button.

10. The electronic timepiece described in claim 1, further comprising:

a first switch, and a second switch, wherein the operation detector is configured to detect forward rotation of the crown based on input from the first switch, the operation detector is configured to detect reverse rotation of the crown based on input from the second switch, the time setter is configured to add the adjustment amount to the time displayed when the operation detector detects forward rotation of the crown, and the time setter is configured to reduce the adjustment amount to the time displayed when the operation detector detects reverse rotation of the crown.

* * * * *